US007724110B2

(12) United States Patent
Abbaspour-Tamijani et al.

(10) Patent No.: US 7,724,110 B2
(45) Date of Patent: May 25, 2010

(54) COMPACT SWITCHABLE FILTER FOR SOFTWARE-DEFINED RADIO

(75) Inventors: Abbas Abbaspour-Tamijani, Scottsdale, AZ (US); Masoud Koochakzadeh, Tempe, AZ (US)

(73) Assignee: Arizona Board of Regents for and on behalf of Arizona State University, Scottsdale, AZ (US)

( * ) Notice: Subject to any disclaimer, the term of this patent is extended or adjusted under 35 U.S.C. 154(b) by 237 days.

(21) Appl. No.: 11/906,323

(22) Filed: Oct. 1, 2007

(65) Prior Publication Data

US 2008/0111652 A1 May 15, 2008

Related U.S. Application Data

(60) Provisional application No. 60/848,548, filed on Sep. 29, 2006.

(51) Int. Cl.
*H01P 1/203* (2006.01)

(52) U.S. Cl. ..... 333/205; 333/235

(58) Field of Classification Search ..... 333/202–205, 333/235, 33, 165–168, 175, 176, 185
See application file for complete search history.

(56) References Cited

U.S. PATENT DOCUMENTS

| | | | | |
|---|---|---|---|---|
| 4,835,499 | A * | 5/1989 | Pickett | 333/205 |
| 6,452,465 | B1 * | 9/2002 | Brown et al. | 333/205 |
| 6,597,265 | B2 * | 7/2003 | Liang et al. | 333/204 |
| 6,784,766 | B2 | 8/2004 | Allison et al. | 333/205 |
| 6,917,259 | B2 * | 7/2005 | Hirabayashi | 333/105 |
| 7,482,887 | B2 * | 1/2009 | Cyr et al. | 331/108 C |
| 7,555,278 | B2 * | 6/2009 | Contopanagos et al. | 455/307 |
| 2005/0012565 | A1 * | 1/2005 | Kamata et al. | 333/174 |
| 2006/0087388 | A1 * | 4/2006 | Kawai et al. | 333/219 |

OTHER PUBLICATIONS

Abbaspour-Tamijani, "Miniature and tunable filters using MEMS capacitors," *IEEE Transactions on Microwave Theory and Techniques*, 51(7):1878-1885, 2003.

Carey-Smith et al., "Wide tuning-range planar filters using lumped-distributed coupled resonators," *IEEE Transactions on Microwave Theory and Techniques*, 53(2):777-785, 2005.

(Continued)

*Primary Examiner*—Benny Lee
*Assistant Examiner*—Gerald Stevens
(74) *Attorney, Agent, or Firm*—Fulbright & Jaworski L.L.P.

(57) ABSTRACT

A switchable bandpass filter includes a coupled line segment (comb) including a plurality of coupled transmission lines of substantially equal lengths that are each connected or otherwise coupled to the common RF ground at their first end, a plurality of adjustable capacitors each coupled proximate a second end of respective ones of the transmission lines, and a plurality of shunt switches coupled to points along a length of each of the transmission lines. Shunt switches may be implemented by various device technologies including MEMS and FET switches and PIN diodes. The adjustable capacitors may be implemented as an array or tree of switched capacitors using suitable switching components (e.g., as previously enumerated) or by other suitable electrically controllable devices such as varactors or varactor arrays. A differential switchable filter may be formed by the symmetric repetition of individual bandpass filter modules.

3 Claims, 9 Drawing Sheets

OTHER PUBLICATIONS

Dusspot and Rebeiz, "Intermodulation distortion and power handling in RF MEMS switches, varactors and tunable filters," *IEEE Trans. Microwave Theory and techniques*, 51:1247-1256, 2003.

Entasari et al., "A 12-18-GHz Three-Pole RF MEMS Tunable Filter," *IEEE Transactions on Microwave Theory and Techniques*, 53(8):2566-2571, 2005.

Entasari et al., "A differential 4-bit 6.5-10-GHz RF MEMS tunable filter," *IEEE Transactions on Microwave Theory and Techniques*, 53(3):1103-1110, 2005.

Fourn et al., "MEMS switchable interdigital coplanar filter," *IEEE Transactions on Microwave Theory and Techniques*, 51(1):320-324, 2003.

Hong and Lancaster, *Microstrip Filters for RF/Microwave Application*, John Wiley and Sons, Hoboken, NJ, 2001 (Cover Page and Table of Contents).

Lee et al., "Millimeter-wave MEMS tunable low pass filter with reconfigurable series inductors and capacitive shunt switches," *IEEE Microwave and Wireless Components Letters*, 15(10):691-693, 2005.

Matthaei et al., *Microwave Filters, Impedance-matching networks, and Coupling Structures*, New York, McGraw-Hill, 1964 (Cover Page and Table of Contents).

Pillans et al., "6-15 GHz RF MEMS tunable filters," *2005 IEEE MTT-S International*, p. 919-922, 2005.

Rebeiz, *RF MEMS, Theory, Design, and Technology*, Wiley Interscience, 2002 (Cover Page and Table of Contents).

* cited by examiner

COMPACT SWITCHABLE FILTER FOR SOFTWARE-DEFINED RADIO

CLAIM TO DOMESTIC PRIORITY

The present non-provisional patent application claims benefit of priority to provisional application Ser. No. 60/848,548, entitled "MEMS Bandpass Filter with Very Wideband Tuning", filed on Sep. 29, 2006 which is incorporated herein in its entirety by reference.

BACKGROUND OF THE INVENTION

1. Field of the Invention

The present invention relates generally to radio systems and, more particularly, to filters with a wide frequency tuning range.

2. Description of Art

Bandpass filters are widely used in electronic communication systems. In conventional radio transceivers with a single standard and fixed band of operation, bandpass filters are designed for a predetermined center frequency and bandwidth. Fixed RF filters are usually realized using lumped element L-C resonators, transmission-line and waveguide resonators, ceramic resonators, surface acoustic wave (SAW) resonators, and most recently, film bulk acoustic resonators (FBAR).

In multi-standard single-platform radio applications, such as software-defined radio (SDR) transceivers, however, the frequency range of interest spans nearly two decades. A typical SDR transceiver may cover from approximately 30 and 3000 MHz. This wide frequency range is typically divided into a number of narrower bands. Radio frequency (RF) bandpass filters in the existing SDR transceivers are realized in the form of switchable filter banks. An N-band switchable filter bank is composed of two single-pole-N-throw (SPNT) selector switches and an array of N-fixed-frequency bandpass filters. At a given mode of operation, depending on the frequency of interest, the SPNT switches route the RF signal through only one of the filters, and bypass the rest. As the number of bands is generally large for wideband SDR, the filter bank approach drastically increases the size, weight, and manufacturing cost of the SDR RF front-end. Also, as the filters for different bands are generally implemented using different technologies, integrating a large number of these filters in a single module can be very challenging.

In an alternative scenario, RF filtering can be achieved in a more compact fashion, by using programmable MEMS switched-band filters. Requirements for such filters are often low insertion loss, high linearity, maximum power handling, and minimum complexity. Competing technologies for tunable filter designs are based on using solid-state varactors, p-i-n diode switches, MEMS varactors, and ferroelectric varactors. Varactor-based designs typically suffer from insufficient tuning range and are mostly power inefficient. Switch-based designs using solid state devices typically offer poor performance in terms of insertion loss and linearity.

MEMS-based tunable and switched-band filters reported in the existing literature typically have tuning ranges of less than one octave and narrow bandwidth. MEMS tunable filters have been described by Entasari et al., in "A 12-18-GHz Three-Pole RF MEMS Tunable Filter", IEEE Transactions on Microwave Theory and Techniques, Volume 53, Issue 8, August 2005 Page(s): 2566-2571, by Pillans et al., in "6-15 GHz RF MEMS tunable filters", 2005 IEEE MTT-S International, 12-17 Jun. 2005 Page(s): 919-922, by Entasari et al. in "A differential 4-bit 6.5-10-GHz RF MEMS tunable filter", IEEE Transactions on Microwave Theory and Techniques, Volume 53, Issue 3, Part 2, March 2005 Page(s): 1103-1110, by Abbaspour-Tamijani et al. in "Miniature and tunable filters using MEMS capacitors", IEEE Transactions on Microwave Theory and Techniques, Volume 51, Issue 7, July 2003 Page(s): 1878-1885, by Lee et al., in "Millimeter-wave MEMS tunable low pass filter with reconfigurable series inductors and capacitive shunt switches", IEEE Microwave and Wireless Components Letters [see also IEEE Microwave and Guided Wave Letters], Volume 15, Issue 10, October 2005 Page(s): 691-693, by Fourn et al., in "MEMS switchable interdigital coplanar filter", IEEE Transactions on Microwave Theory and Techniques, Volume 51, Issue 1, Part 2, January 2003 Page(s): 320-324, and by Carey-Smith et al. in "Wide tuning-range planar filters using lumped-distributed coupled resonators", IEEE Transactions on Microwave Theory and Techniques, Volume 53, Issue 2, February 2005 Page(s): 777-785, all of which are incorporated herein by reference.

MEMS tunable filters with broader tunable ranges have also been described by Allison et al., in U.S. Pat. No. 6,784,766, incorporated herein by reference.

SUMMARY OF THE INVENTION

Preferred embodiments of the invention presented here are described in the Description of the Invention and attached documents. Unless specifically noted, it is intended that the words and phrases in the specification and the claims be given the ordinary and accustomed meaning to those of ordinary skill in the applicable arts. If any other special meaning is intended for any word or phrase, the specification will clearly state and define the special meaning. In particular, most words have a generic meaning. If it is intended to limit or otherwise narrow the generic meaning, specific descriptive adjectives will be used to do so. Absent the use of special adjectives, it is intended that the terms in this specification and claims be given their broadest possible, generic meaning.

Likewise, the use of the words "function" or "means" in the Description of the Invention is not intended to indicate a desire to invoke the special provisions of 35 U.S.C. 112, Paragraph 6, to define the invention. To the contrary, if it is intended to invoke the provisions of 35 U.S.C. 112, Paragraph 6, to define the inventions, the claims will specifically recite the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to provoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

According to one aspect of the invention, a filter includes a coupled transmission line segment (comb) comprising a plurality of coupled transmission lines of substantially equal lengths, a plurality of adjustable capacitors each coupled proximate a first end of respective ones of the transmission lines, and a plurality of shunt switches coupled to points along a length of each of the transmission lines.

According to a feature of the invention, shunt switches may be operable to selectively ground the transmission lines at various points or positions along the transmission lines.

According to another feature of the invention, an end of each of transmission line is grounded.

According to another feature of the invention, an input RF signal line is coupled to a first one of the transmission lines, an output RF signal line is coupled to a last one of the transmission lines, and an input RF signal received on the input RF signal line is coupled from each of the transmission lines to the next starting with the first transmission line and ending with the last transmission line and is extracted as a filtered output signal from the output RF signal line.

According to another feature of the invention, the shunt switches comprise MEMS switches, PIN diodes and/or FET switches.

According to another feature of the invention, each of the adjustable capacitors comprises a plurality of switchable fixed capacitors and/or a varactor.

According to another feature of the invention, the filter is operable at some highest usable frequency corresponding to a guided wavelength $\lambda_{g,min}$ that is not shorter than twice the overall length of each of the transmission lines.

According to another feature of the invention, the coupled transmission line segment has a substantially constant cross-sectional geometry and/or area throughout the entire length of the coupled transmission line segment.

According to another feature of the invention, the coupled transmission line segment has a variable cross-sectional geometry and/or area throughout at least a portion of the length of the coupled transmission line section.

According to another feature of the invention, control logic is coupled to the adjustable capacitors and to the shunt switches to provide a control signal to the adjustable capacitors and to the shunt switches for tuning the filter.

According to another feature of the invention, control logic is responsive to a frequency of a signal applied to the filter, the control logic being coupled to the adjustable capacitors and to the shunt switches to provide a control signal to the adjustable capacitors and the shunt switches for tuning the filter for the frequency.

According to another aspect of the invention, a switchable bandpass filter includes a plurality of parallel coupled transmission lines, an RF input terminal coupled to a first one of the transmission lines, and an RF output terminal coupled to a last one of the transmission lines. A plurality of shunt switches are coupled to the transmission lines at a plurality of positions along a length of each of the transmission lines, and a plurality of switchable capacitors are coupled to respective ones of the transmission lines.

According to another feature of the invention each of the coupled transmission lines comprises a conductive material having a substantially constant cross-sectional geometry and/or area.

According to another feature of the invention each of the coupled transmission lines comprises a conductive material having a varying cross-sectional geometry and/or area.

According to another feature of the invention each of the shunt switches comprises an electrically actuatable switching device selected from the group consisting of (i) MEMS switches, (ii) PIN diodes, and (iii) FET switches, and each of the switchable capacitors comprises electrically controllable capacitors selected from the group consisting of (i) arrays of electrically selectable fixed capacitors, (ii) varactors, and (iii) arrays of electrically selectable varactors.

According to another feature of the invention the filter may include an RF substrate having a top side onto which are attached the transmission lines and an RF ground conductor on a bottom side of the RF substrate. A first plurality of via holes may be provided, each corresponding to a first segment or end of each of the transmission lines, the via holes formed beneath each of the transmission lines and extending through and to the bottom side of the RF substrate to connect to the RF ground conductor. A second plurality of via holes are located in a second segment or end associated with respective ones of the transmission lines, wherein the positions along the lengths of the transmission lines are selectively coupled to the RF ground conductor through corresponding ones of the switchable shorts. The switchable capacitors couple the transmission lines to the RF ground conductor through corresponding ones of the second plurality of via holes.

According to another feature of the invention, the filter may include an RF ground conductor and an RF substrate having top and bottom sides. The transmission lines, switchable shorts, and switchable capacitors may be attached to the top side and the RF ground conductor attached to the bottom side of the RF substrate. A plurality of via holes may be formed beneath and along a length of each of the transmission lines and extend from the top side through and to the bottom side of the RF substrate. The switchable shorts and switchable capacitors may each be connected between the transmission line and the RF ground conductor through respective ones of the via holes.

According to another aspect of the invention a coplanar switchable bandpass filter may include an RF substrate. A plurality of parallel coplanar waveguide (CPW) coupled transmission lines may be attached to a top side of the RF substrate with an RF input terminal connected to a first one of the coupled transmission lines and an RF output terminal connected to a last one of the coupled transmission lines. Some of the transmission lines may be coupled through switchable capacitors. An RF ground conductor may lay on the top side of the RF substrate. A plurality of shunt switches may be attached to the top side of the RF substrate and connect the coupled transmission lines and the RF ground plane. A plurality of switchable capacitors may be connected to the top side of the RF substrate, each of the switchable capacitors coupled between respective ones of the transmission lines and the RF ground conductor.

According to another aspect of the invention a differential switchable filter may be obtained from a symmetric repetition of switchable filter modules including (i) a plurality of parallel coupled transmission lines each divided into two separated halves at their respective midpoints; (ii) a pair of differential RF input terminals connected or otherwise coupled to the two halves of a first one of the transmission lines; (iii) a pair of differential RF output terminals connected to the two halves of a last one of the transmission lines; (iv) a first plurality of via holes or coplanar shorts connecting the two ends of each of the coupled transmission lines to the RF ground conductor; (v) a second plurality of shunt switches at positions along a length of each of the transmission lines connecting the respective ones of the transmission lines to the RF ground conductor; and (vi) a plurality of adjustable capacitors connected in series between the two halves of each one of the coupled transmission lines.

According to another aspect of the invention a differential switchable filter comprises a symmetric repetition of a switchable filter module. The differential switchable filter includes a plurality of parallel coupled transmission lines, each divided to two separated halves at their respective approximate midpoints. A pair of differential RF input terminals are connected or otherwise coupled to the two halves of a first one of the transmission lines and a pair of differential RF output terminals are connected or otherwise coupled to the two halves of a last one of the transmission lines. A first plurality of conductors (e.g., via holes or coplanar shorts) couple the two ends of each of the coupled transmission lines to an RF ground conductor. A second plurality of shunt switches at positions spaced along a length of each of the transmission lines couple the respective ones of the transmission lines to the RF ground conductor. A plurality of adjustable capacitors are connected or otherwise coupled in series between the two halves of each one of the coupled transmission lines.

According to another aspect of the invention a differential switchable filter may be obtained from a switchable filter module including transmission lines, each transmission line having a pair of opposing elongate conductors formed, attached or otherwise located on opposite surfaces or sides of an RF or similar substrate. Thus, a plurality of parallel coupled transmission lines are each composed of two conductors located on top and bottom sides of the substrate, each conductor of a pair of conductors substantially mirroring each other. A pair of differential RF input terminals are coupled (e.g., are connected directly or indirectly) to respective top and bottom conductors of an initial or first one of the transmission lines (e.g., an outermost.) Similarly, a pair of differential RF output terminals are coupled to the top and bottom conductors of a final or last one of the transmission lines (e.g., an outermost opposite the first transmission line). A first plurality of via holes couple a first end of each pair of the top and bottom conductors of the coupled transmission lines. A second plurality of via holes are located at positions along the length of each of the transmission lines and are coupled to the top conductors of the respective transmission line. A plurality of shunt switches placed at positions along the bottom conductor of each transmission line respectively couple the second plurality of via holes and the top conductor of the respective transmission line. A plurality of adjustable capacitors couple a second end of each pair the top and bottom conductors of the coupled transmission lines.

It should be noted that, as used herein:

The term "coupled" with regard to electrical matters is defined as electromagnetically connected, although not necessarily through wires or metallic traces, and not necessarily directly connected. For example, two components can be "coupled" even if there are intervening components.

The terms "a" and "an" are defined as one or more unless this disclosure explicitly requires otherwise.

The term "substantially," "about," and their variations are defined as being largely but not necessarily wholly what is specified as understood by one of ordinary skill in the art, and in one non-limiting embodiment, substantially refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

The following abbreviations are defined as indicated:

| | |
|---|---|
| FBAR | Film Bulk Acoustic Resonators |
| SDR | Software-Defined Radio |
| RF | Radio Frequency |
| SPNT | Single-Pole-N-Throw |
| SAW | Surface Acoustic Wave |
| MEMS | Microelectromechanical systems |
| FET | field-effect transistor |
| PIN Diode | Diode with a wide, undoped Intrinsic semiconductor region between P-type semiconductor and N-type semiconductor regions |
| SBC | Switched-band Combine |
| SCF | Switched-capacitor filter |
| CPW | Coplanar Waveguide |
| MIM | Metal-Insulator-Metal |

Other features and associated advantages will become apparent with reference to the following detailed description of specific embodiments in connection with the accompanying drawings.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein. The drawings are examples only and are not intended to limit the scope of the invention.

DESCRIPTION OF ILLUSTRATIVE EMBODIMENTS

Figure 1:
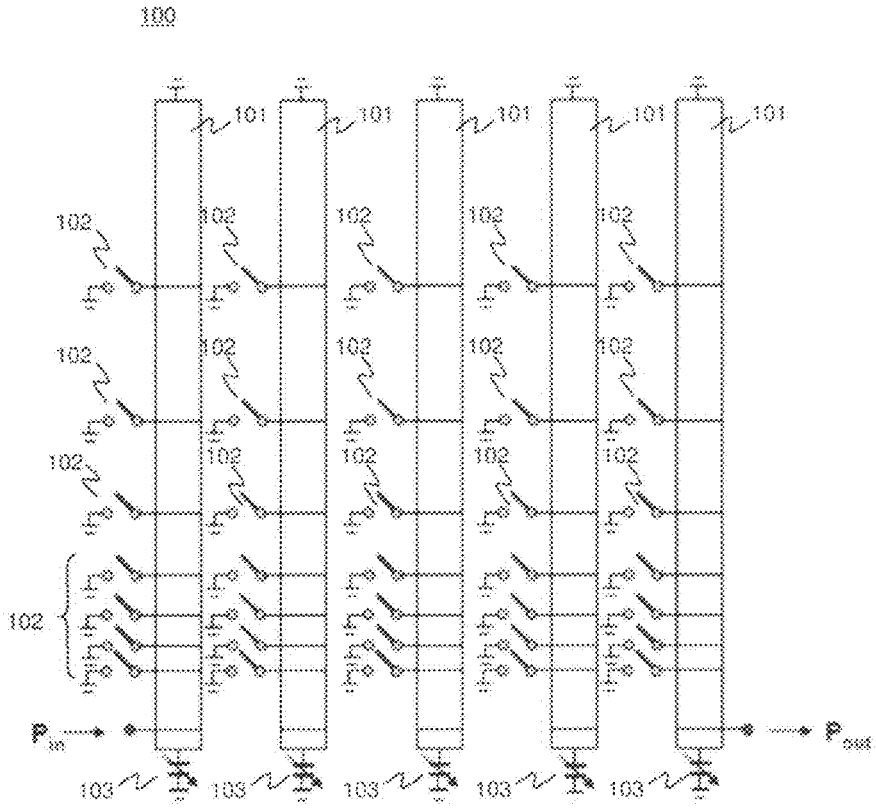
FIG. 1 is a schematic diagram of a 5-pole, 8-mode, switched-band combine (SBC) filter.

The invention and the various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

Embodiments of the invention concern a switched-band filter with a broad frequency tuning range. Although embodiments may use MEMS technology, the invention may be implemented using other devices such as PIN diodes, FETs and similar devices to provide switching capabilities, electrically controllable capacitance devices such as varactors to provide controllable capacitances, etc. More specifically, one embodiment of the invention involves a compact programmable bandpass filter solution that can be used for a wide range of applications such as, for example, in the RF front-end of multi-band transceivers. With a wideband (e.g., at least 1 octave) and even very wideband (e.g., two or more octaves) tuning capability and a low-complexity tuning scheme, the filter is particularly suitable for SDR-defined radio architectures, where it can replace RF SPNT switches and filter banks. Embodiments of the filter may be based on an integration of RF-MEMS switches within a self-scaled filter topology although other implementations may be used. The term "self-scaled" refers to the fact that the filter structure may be simply scaled with the wavelength in different frequency bands of operation. This results in a consistent performance and frequency response in all modes of operation. Embodiments of the invention can provide such a self-scaled topology that can be referred to as Switchable Combline Filter (SCF). One embodiment involves a SCF using RF-MEMS technology. However, the architecture can be implemented using other types of RF switches, such as p-i-n or PIN diodes or the like.

Referring to the two documents both entitled "Compact MEMS Switched-Band Filters for Software Defined Radio" attached to the referenced, earlier-filed U.S. Provisional Patent Application Ser. No. 60/848,548, the disclosure of which together with the attachments have been incorporated by reference herein, a tunable filter with a center frequency that is tunable for more than a decade (i.e., at least "wideband", covering more than one octave) and that can preserve consistent performance in all modes of operation is described. The filter is based in part on integration of RF-MEMS switches within a self-scaled filter topology. This integration of technologies allows a compact programmable bandpass filter solution that can be used for applications in the RF front-end of multi-band transceivers. This filter topology uses coupled transmission lines and load capacitances. The technology provides methods to render this filter topology programmable, through the introduction of integrated MEMS switches. With this method, the transmission line lengths can be varied along with the load capacitors (realized as a switchable capacitor bank). By changing the state of the switches, the length of the coupled transmission line section can be changed dynamically, resulting in a self-scaled structure, that possess a similar electrical length in all bands of operation. The self-scaled nature of this embodiment allows the values of the inter-resonator coupling coefficients to remain constant upon switching from one band to another. This results in consistent performance and frequency response in all modes of operation.

Characteristics of this example filter include

1. A Small Footprint—The filter can be compact. In one embodiment it may be only 1×2 cm when implemented for 220-2800 MHz frequency range.

2. High Linearity—The frequency response of the filter is insensitive to the levels of the input RF power, up to nearly 10 watts in one embodiment.

3. Low Insertion Loss—The attenuation of the signal due to the filter is minimal when designed using low-loss transmission lines, allowing for increased system performance.

4. High Power Handling—When combined with high power switches this filter has the ability to handle high power levels of up to several watts, so that it can be used for both receiver and transmitter circuits.

5. Low Variation Due to Temperature—Can be employed in applications with large temperature variations.

6. Minimum Complexity—A single filter can reduce overall system complexity and help increase reliability.

Switched-band filter topologies according to embodiments of the invention may (but need not) be based on RF MEMS technology for application in, for example, software-defined radio (SDR) transceivers. The frequency range of interest for this type of application, in one embodiment, spans nearly two decades or octaves (between approximately 30 and 2800 MHz), which is divided into 13 bands (Table I).

TABLE I

Frequency Bands for Software-Defined Radio

| | | Ideal Pass-band MHz | | Center Frequency | Fractional |
|---|---|---|---|---|---|
| | Filter # | Low | High | MHz | Bandwidth % |
| Group 1 | 1 | 30 | 55 | 40.62 | 61.5 |
| | 2 | 55 | 88 | 69.57 | 47.4 |
| | 3 | 88 | 137 | 109.80 | 44.6 |
| | 4 | 137 | 225 | 175.57 | 50.1 |
| | 5 | 225 | 300 | 259.81 | 28.9 |
| | 6 | 300 | 400 | 346.41 | 28.9 |
| | 7 | 400 | 540 | 464.76 | 30.1 |
| | 8 | 540 | 740 | 632.14 | 31.6 |
| | 9 | 740 | 1000 | 860.23 | 30.2 |

TABLE I-continued

Frequency Bands for Software-Defined Radio

| | Filter # | Ideal Pass-band MHz Low | Ideal Pass-band MHz High | Center Frequency MHz | Fractional Bandwidth % |
|---|---|---|---|---|---|
| Group 2 | 10 | 1000 | 1350 | 1161.90 | 30.1 |
| | 11 | 1350 | 1720 | 1523.81 | 24.2 |
| | 12 | 1720 | 2200 | 1945.25 | 24.6 |
| | 13 | 2200 | 2800 | 2481.94 | 24.1 |

RF bandpass filter banks can be integral parts of the contemporary SDR architectures and are sometimes necessary for image-rejection and pre-filtering in the receiver and harmonic-rejection in the transmitter. In an alternative scenario, RF filtering can be achieved in a more compact fashion by using programmable MEMS switched-band filters. Switched-band filters can be realized by integrating switchable components in the structure of lumped-element or distributed bandpass filters. However, to avoid spurious higher order pass-bands, one may divide the frequency bands into two groups and replace the filter bank by the combination of two switched-band filters, each covering one decade. In the 300-2800 MHz range, the lumped inductors may suffer from excessive loss, and using a distributed filter approach may be preferable for a multitude of reasons. Transmission-line resonators can attain quality factors of up to 100 at lower microwave frequencies, lend themselves easily to planar designs, and can be readily fabricated using standard IC technologies. For lower frequency bands in the 30-300 MHz range, the distributed designs may not guarantee a better performance and can be impractical due to large dimensions. However, they still have the advantage of a planar topology and may present a viable option if extra high-dielectric ceramic substrates are used to enable miniaturization. Lumped element inductors principally have an adequate performance at these frequencies, but their increasingly large dimensions and 3D geometry may not be as favorable from the point of view of manufacturability and integrability.

Embodiments of the present invention provide a switched-band filter structure that covers the upper part of the frequency range (e.g., Group 2 frequencies of 300-2800 MHz) and utilizes the distributed approach. The lower band filter can be addressed using other techniques including the use of exotic materials and high-Q planar inductors.

I. System Considerations for MEMS Switched-Band Filters

In both receive and transmit modes, low insertion loss and high linearity can be important to the design of high-performance filters. In the receive path, the insertion loss of the filter is directly added to the noise figure of the receiver. In the transmit path, the insertion loss reduces the transmitted power and directly affects the power efficiency and hence the battery life. The insertion loss of a bandpass filter is inversely proportional to the unloaded quality factor of the comprising resonators and the fractional bandwidth of the filter. (See, for example, G. L. Matthaei, L. Young, and E. M. T. Jones, Microwave Filters, Impedance-matching networks, and Coupling Structures, New York, McGraw-Hill, 1964, incorporated herein in its entirety by reference.) A 5-pole Chebyshev bandpass filter with 30% bandwidth has an insertion loss of less than 2 dB for a resonator Q of only 50, which is readily attainable using planar T-Line resonators and MIM (metal-insulator-metal) capacitors. The Ohmic resistance of the integrated MEMS switches, however, can significantly lower the resonator Q. A low-loss MEMS filter design, therefore, may use a minimal number of MEMS switches in the signal path in all mode of operation.

Nonlinearities, in the receive path, can mix strong out-of-band interferers and generate in-band intermodulation products. These IM products can reduce the input SNIR and limit the sensitivity of the receiver. In the transmit path, they can distort the transmitted signal and generate unwanted out of band harmonics. The nonlinear phenomenon in MEMS switches with electrical actuation in the up-state is well understood and is attributed to the quasi-static force component generated by the RF voltage between the MEMS switch structure and the signal line. (See, for example, J. S. Hong and M. J. Lancaster, Microstrip Filters For RF/Microwave Application, John Wiley and Sons, Hoboken, N.J., 2001, incorporated herein in its entirety by reference.) Because of the low-pass mechanical response of the MEMS bridge (or cantilever) this force undergoes significant suppression, and the MEMS switches can prove to be highly resistant to out-of-band mixing effects. The situation can be less favorable for the harmonic generation and self-biasing effects. IIP3s of up to 50 dBm are attainable from typical MEMS switches, and a similar degree of linearity is expected from switched-band filters.

Power handling is another consideration when the filters are to be used in the output stage of the transmitter. Power handling of the RF MEMS switches and varactors is generally limited by failure mechanisms such as switch self-actuation, or by nonlinear phenomena such as self-modulation. In tunable filter designs maximum rating is generally dictated mainly by self-tuning. In switched-band filter topologies, self-actuation is often the limiting factor. Filters based on MEMS switches with high self-actuation voltages can be designed to operate fairly linearly under several watts of RF power. The topology of the filter, the mechanical design of the MEMS switches and their location in the filter structure, and the actuation scheme, are parameters that are often considered in order to enable adequate power handling. Also, for hot switching, permanent failure mechanisms such as micro-welding which impact the life time of the device are often taken into account. (See, for example, G. M. Rebeiz, RF MEMS, Theory, Design, and Technology, Wiley Interscience, 2002, incorporated herein in its entirety by reference.)

Another consideration in designing switched-band filters is complexity, which should typically be minimized by limiting the number of variable components and control voltages (currents). While in principle it is possible to achieve any desired frequency response if every component in the filter structure is made variable, an extravagant use of reconfigurable elements and MEMS switches can lead to impractical designs with overly complex structure, elaborate control algorithm/hardware, and low RF performance. In the distributed designs, it is also true that some of the couplings are predominantly dependent on the design layout and substrate properties, and can hardly be changed by using switchable components. A practical scenario which has proved successful in the past, assumes that the fractional bandwidth of the filter remains unchanged in all modes of operation. (See, for example, L. Dusspot, and G. M. Rebeiz, "Intermodulation distortion and power handling in RF MEMS switches, varactors and tunable filters," IEEE Trans. Microwave Theory and techniques, vol. 51, 1247-1256, April 2003 and A. Abbaspour-Tamijani, L. Dussopt, and Gabriel M. Rebeiz, "Miniature and tunable filters using MEMS capacitors," IEEE Trans. Microwave Theory and Techniques, vol. 51, pp. 1878-1885, July 2003, both of which are incorporated herein in their entireties by reference.) This constraint, which in most cases can be enforced with no major penalties on the system performance, may be exploited to reduce the complexity of the switched-band filter by eliminating the variable couplings. Small variations in the fractional bandwidth, if necessary, can be accommodated by subtle alteration of the filter design (for example the bandwidth variations among the upper frequency bands of Table I).

II. Switched-Band Combline Design (SBC)

A compact switched-band design can be obtained by integrating MEMS switches and switchable MIM capacitors in the structure of a tapped combline filter. An N-pole tapped combline filter (also known as pseudo-combline filter) is comprised of N substantially equal-length sections of coupled transmission lines which are short-circuited in one end and loaded by lumped element capacitors in the other end. (See, for example, K. Entesari, and Gabriel M. Rebeiz, "A differential 4-bit 6.5-10 GHz RF MEMS tunable filter," IEEE Trans. Microwave Theory and Techniques, vol. 53, pp. 1103-1110, March 2005, incorporated herein in its entirety by reference.) Every loaded line section forms a resonator with a resonant frequency defined by the length of the section and its loading capacitance. Each resonator is coupled to its neighboring resonator(s) electromagnetically in its t-line portion. The values of the inter-resonator couplings are determined from the mutual impedance and length of the coupled line sections. Input signal is injected to the first resonator, and the output may be picked from the last resonators through simple tapping ports. The locations of these ports determine the values of the input/output couplings for given source/load impedances.

Figure 2:
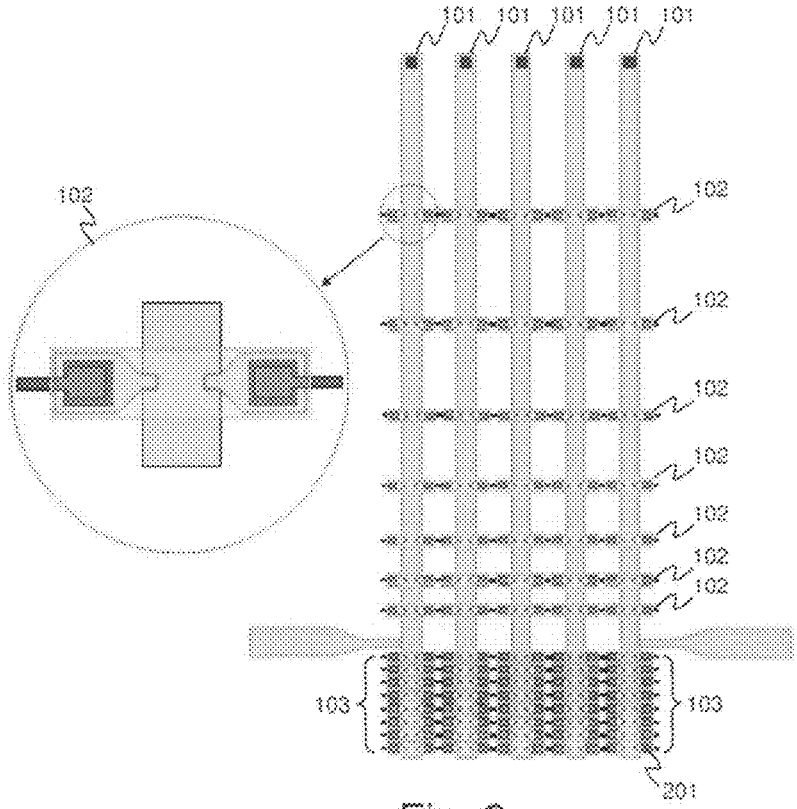
FIG. 2 is the notional layout of a 5-pole, 8-mode, switched-band combine (SBC) filter.

FIG. 1 shows the topology of a 5-pole, 8mode, switched-band combline (SBC) filter 100 including coupled transmission lines 101, MEMS switches 102 and loading capacitors 103. According to this embodiment, MEMS switches 102 are used to vary the coupling lengths and the loading capacitors 103 (realized as switchable capacitor banks) to adjust the center frequency of the filter in different modes of operation. FIG. 2 shows one possible layout of an 8-mode SBC. Each of the loading capacitors 103 is depicted as a bank of MEMS switches and capacitor pairs 201. A switched-band filter designed for the upper portion of the frequency range (see table I) can have the approximate dimensions of 2×1 cm, when fabricated on a high-resistivity GaAs substrate ($\epsilon r$=13.2, tan $\delta$~10−5) and using microstrip technology. Besides its compactness, another advantage of the combline topology is that its second order periodic pass-band can be deterred up to 10-12 times the fundamental resonant frequency. This can be especially beneficial for very wide-band applications such as the SDR.

Figure 3:
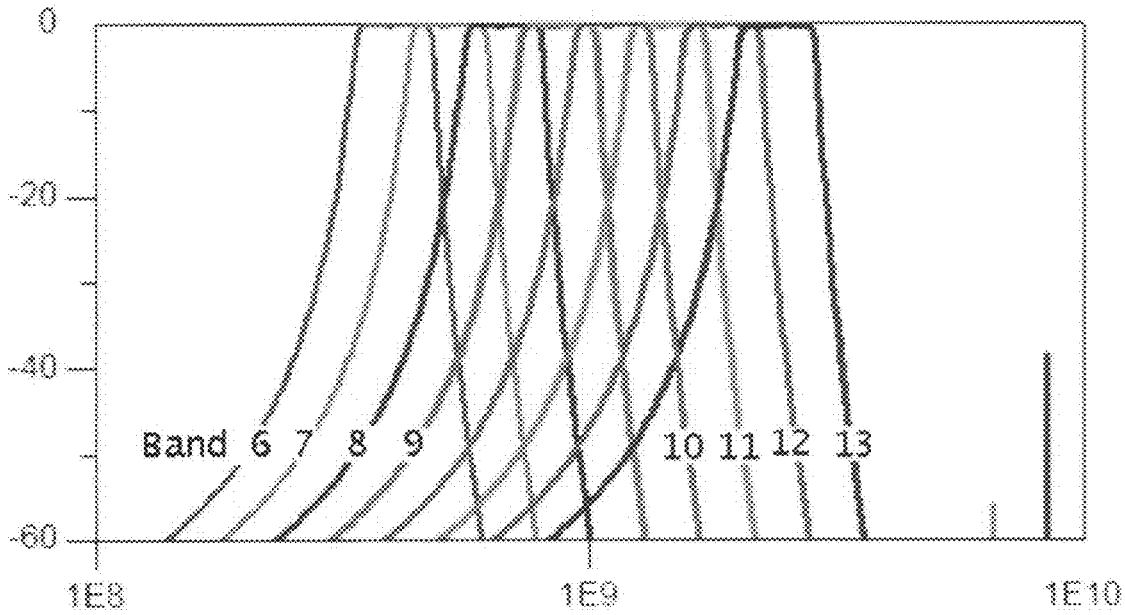
FIG. 3 is a plot of the calculated transmission ($S_{21}$) frequency response for an ideal 5-pole, 8-mode SBC filter.
Figure 4:
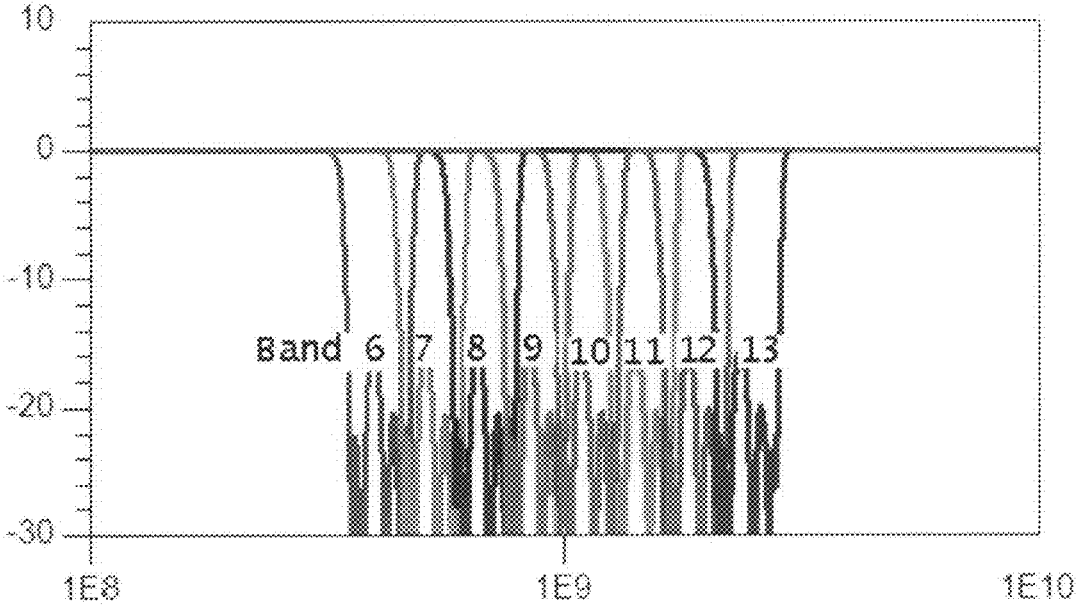
FIG. 4 is a plot of the calculated return loss ($S_{11}$) frequency response for an ideal 5-pole, 8-mode SBC filter.

FIGS. 3 and 4 show the simulated frequency response of the 5-pole SBC filter in its 8-modes of operation in the absence of transmission line and MEMS switch losses. FIG. 3 is a plot of the calculated frequency response for an ideal SBC filter used for transmission ($S_{21}$) while return loss ($S_{11}$) is shown in FIG. 4. In this particular design, the filter is assumed to have a constant fractional bandwidth of 29%. While this is not an accurate assumption referring to the band definitions in Table I, this simulation demonstrates the general frequency behavior expectable from the SBC topology. The fractional bandwidth is related to the inter-resonator couplings which are dependent on length of the coupled line section and the gap between neighboring strips. While the latter cannot be not changed from one mode of operation to another, the former can be adjusted by a calculated placement of the switchable short circuits. However, such adjustments should be kept minimal and may not be capable of realizing bandwidth variations more than a few percent.

MEMS switches can be used to realize the adjustable short-circuits and variable loading capacitors. The inset of FIG. 2 shows the structure of a typical shunt MEMS switch with electrostatic actuation. To isolate the biasing circuitry from the RF signal path and to maximize power handling and linearity of the device, pull-down electrodes can be placed on both sides near to the anchors of the MEMS bridge, and the microstrip line metallization is not used as the pull-down electrode. Also the up-state capacitance of the switch can be minimized by using a dielectric membrane (for example $SiO_2$) which is metallized only at the contact areas. This eliminates the parasitic loading effects of the switches in the up-state and increases the self-actuation voltage.

For the illustrated embodiments, the values of the loading capacitors 103 in different bands of operation vary between 4 and 36 pF. For each resonator, the loading capacitors may be realized using a bank of shunt MIM capacitors which are switched in and out of the circuit using MEMS switches. The MIM capacitors can be realized using thin films of silicon oxide and gold electrodes. Using a 10 nm-thick film of $SiO_2$, a 36 pF capacitor is only 60×60 μm in size and can be easily integrated in series with the MEMS switches. The capacitor banks can be composed of 8 different MIM capacitors with the exact required values, or a fewer number of capacitors with different values that are switched in different combinations to form a digital variable capacitor. The latter method has the advantage of a smaller size and a better overall Q, as the parallel combination of switch-capacitors reduces the effective series resistance. Although the design is optimized for 8 modes of operation, there are many additional modes corresponding to the unused combinations of the capacitor banks and resonator lengths. This capability may prove beneficial in some SDR settings and is attainable using both of the prescribed capacitor bank approaches.

Due to the sensitivity of the filter response to the locations of the MEMS switches and MIM capacitors (especially in the upper bands), it may be desirable that they be either fabricated monolithically along with the resonator structure, or fabricated separately and assembled using a self-aligned flip-chip process. From examining the SBC topology in FIG. 1, it is also evident that many ground connections (via holes) are used in this design. While monolithic fabrication is possible using most standard MEMS processes and might be more attractive for various reasons, any process of choice should be capable of creating via holes with sufficient accuracy.

IV. Loss Effects and Power-Handling Concerns

To obtain a realistic assessment of filter performance under actual circumstances, one can include component imperfections in simulations. Aside from fabrication errors, these imperfections can be divided into two categories: a) loss mechanisms, and b) nonlinearities. In this section a brief discussion of these phenomena and their impact on the performance of SBC are presented.

A. Insertion Loss

Figure 5:
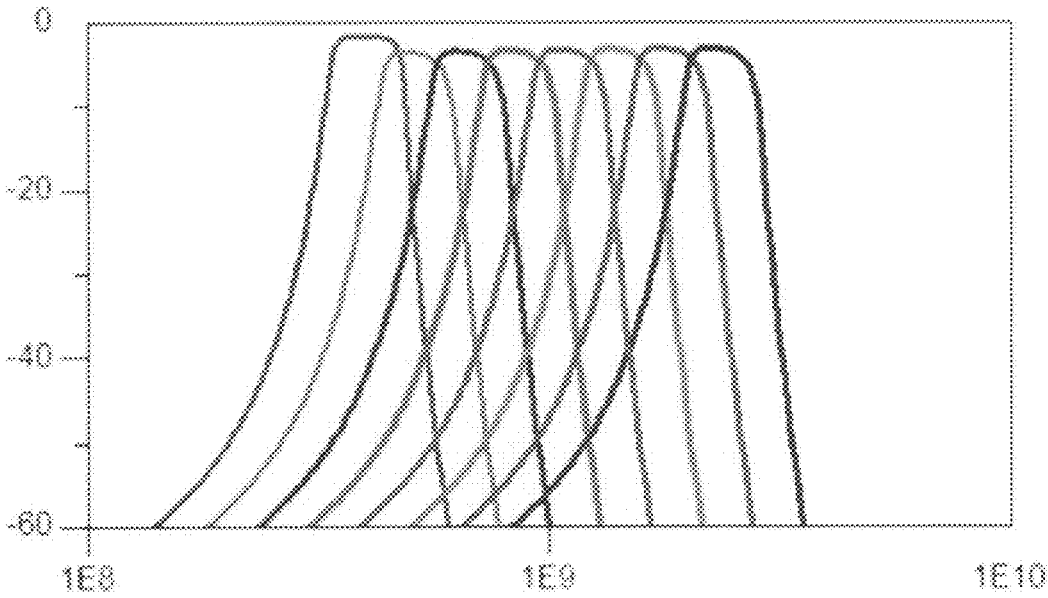
FIG. 5 is a plot of the simulated frequency response of a 5-pole, 8-mode SBC filter after inclusion of transmission line attenuation ($\alpha$=4 dB/m@1 GHz) and switch series resistance ($R_{switch}$=0.3Ω)
Figure 6:
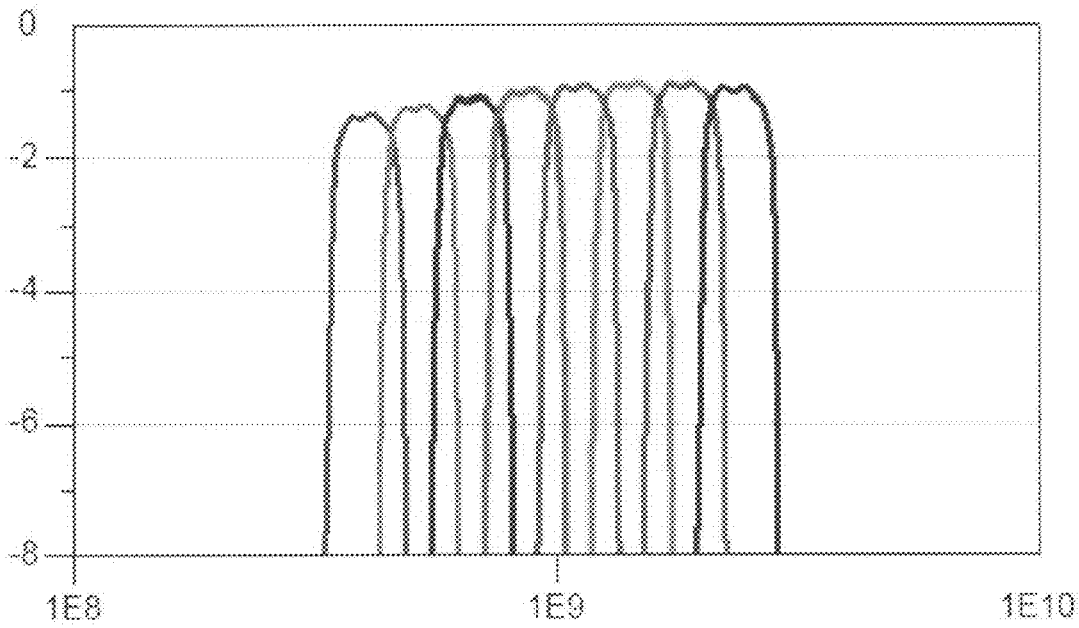
FIG. 6 is a simulated frequency response of an SBC filter with $\alpha$=4 dB/m@1 GHz assuming ideal switches.

Prediction of the filter insertion loss is possible by including the losses of different components in the circuit model. The sources of loss in the SBC structure are the attenuation of the coupled t-line section, the series resistance of the MEMS switches, and the finite quality factor of the MIM capacitors. While the first two mechanisms can significantly impact the performance of the filter, the effect of the last one is generally negligible due to the relatively high quality of MIM capacitors in the frequency range of interest (typically >500). The quality factor of the t-line sections on a high-resistivity GaAs substrate is dominated by the Ohmic losses in and gold metallization. For the SBC simulated in FIGS. 3 and 4 depicting the calculated frequency response for an ideal SBC filter for transmission (FIG. 3) and return loss (FIG. 4), the average value of the attenuation constant is estimated to be ~4 dB/m at 1 GHz (varies as f1/2), which results in a quality factor of $Q_{t\text{-}line}$~60 at this frequency. The value of the series resistance for the MEMS switches is assumed to be 0.3 Ω, which is typical for low-to-moderate force MEMS switches. FIG. 6 shows the simulation results of the SBC filter after the inclusion of transmission line attenuation (α–4 dB/m @ 1 GHz) and assuming ideal switches ($R_{switch}$=0Ω). FIG. 5 shows the simulation results after these losses have been included in the filter model including the simulated frequency response of the SBC filter after inclusion of transmission line attenuation (α=4 dB/m @ 1 GHz) and MEMS switch series resistance ($R_{switch}$=0.3 Ω). While inclusion of the losses does not change the out-of-band rejection of the filter in its different modes, it results in an average mid-band insertion loss of 3.2 dB in bands 7-13 and 1.5 dB in band 6. The significantly lower insertion loss in band 6 is due to the fact that in this band the t-line sections are short-circuited directly, not through the MEMS switches (see FIG. 1). The gradual improvement of the insertion loss towards upper bands can be explained similarly. A parametric study of the design reveals that nearly 1 dB of the observed insertion loss is due to the low Q of the t-line structure, and the rest is caused by the losses in the MEMS switches.

Figure 7:
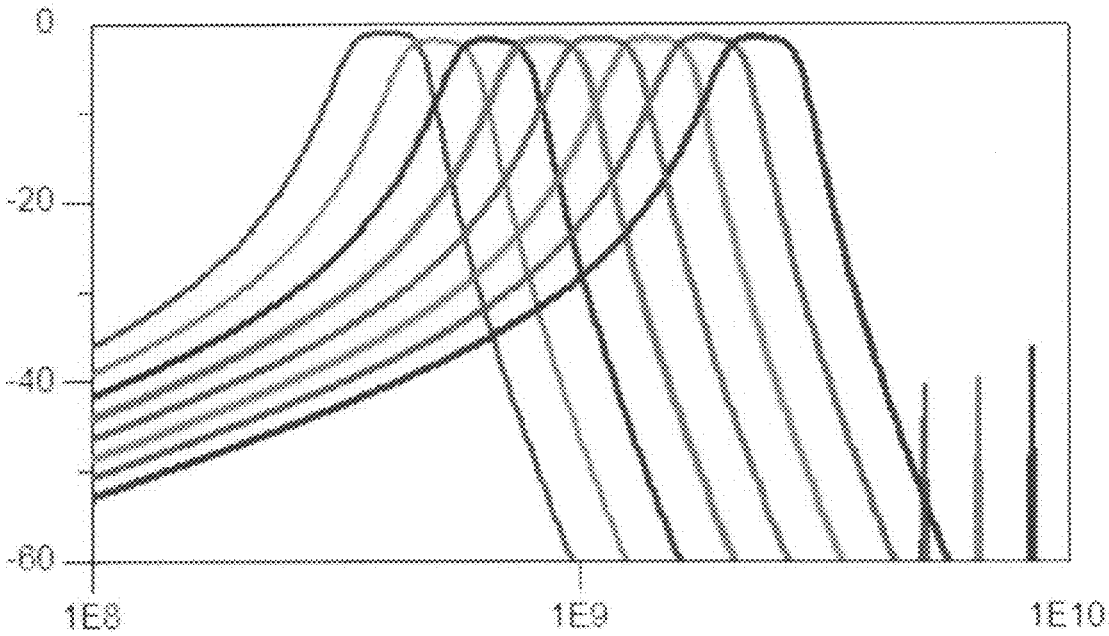
FIG. 7 is a plot of the simulated transmission frequency response of a 3-pole SBC filter with $\alpha$=5.5 dB/m@1 GHz and switch series resistance ($R_{switch}$=0.3Ω)
Figure 8:
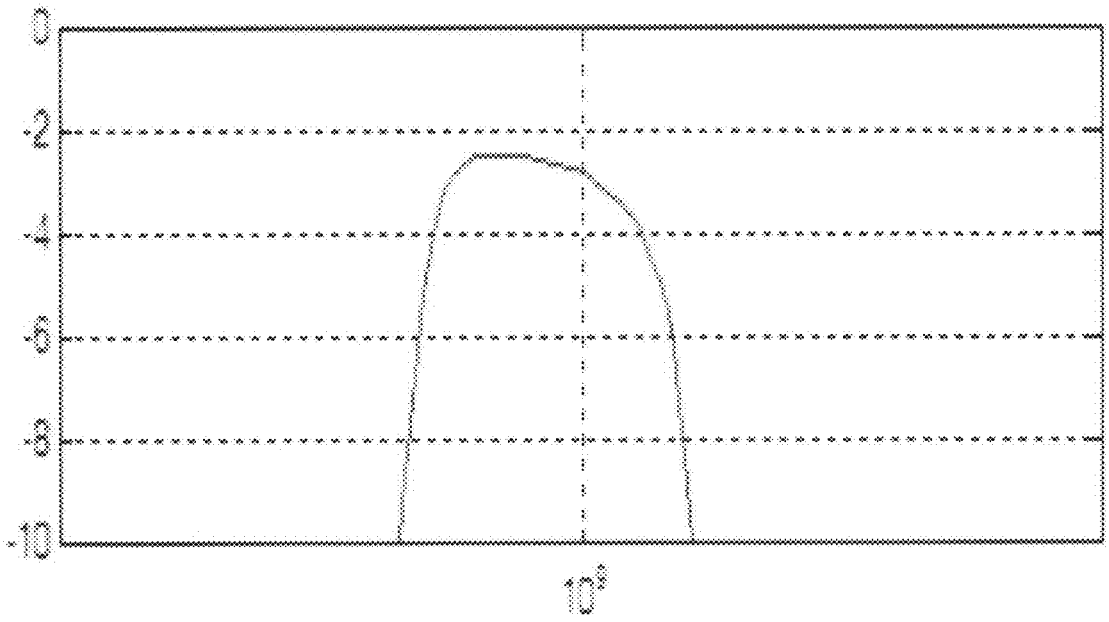
FIG. 8 is a simulated pass-band transmission response of a 5-pole SBC for a pass-band centered at 1 GHz with a reduced switch resistance of 0.15 and reduced t-line attenuation of $\alpha$=2 dB/m.
Figure 9:
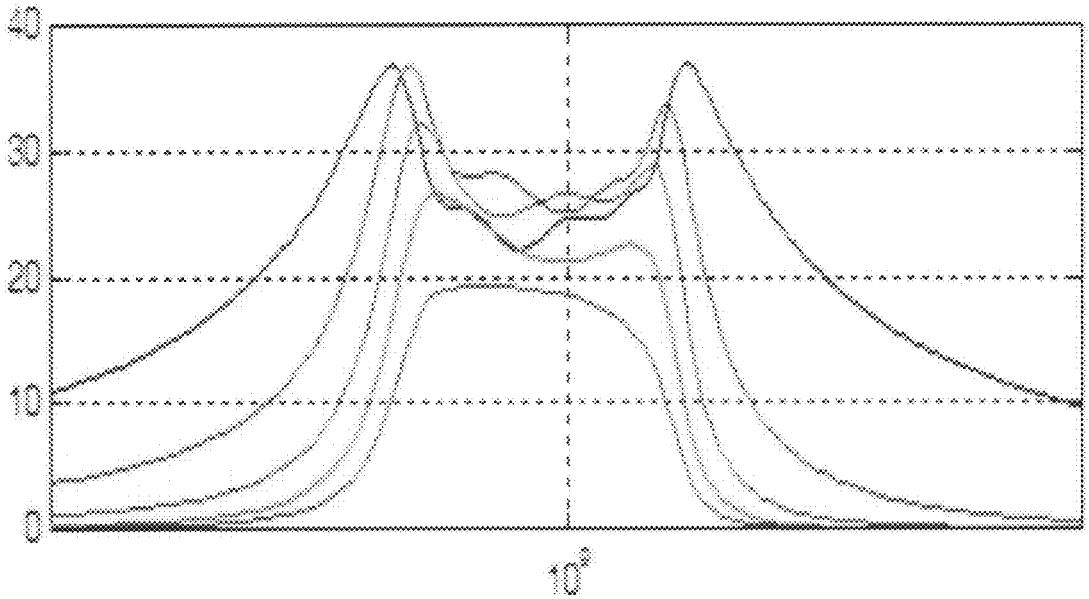
FIG. 9 depicts voltages established across different load capacitors of a 5-pole SBC for a pass-band centered at 1 GHz with a switch resistance of 0.15 and t-line attenuation of $\alpha$=2 dB/m.

Several steps can be taken to reduce the insertion loss in the SBC design. As the most destructive source of loss proves to be the series resistance of the switch, any effort to improve the insertion loss should focus on mitigating this resistance. The switch resistance is composed of two terms: a) the RF resistance of the MEMS bridge, and b) the contact resistance. The former is of the order of 0.05 Ω and generally can be improved by simple modifications such as increasing the bridge width and thickness (through electroplating) where it is possible. The contact resistance can typically only be improved by increasing the effective area of contact by reducing the surface roughness, utilizing a geometrically larger contact region, by increasing the contact force through applying a high hold-down voltage. There is often little to be done about the roughness of the contact surfaces except using low-pressure evaporation techniques. Geometrical enlargement of the contact region increases the up-state capacitance of the switches, which as was mentioned earlier can reduce the self-actuation voltage and limit power handling. High contact force can compromise the life-time and reliability of the switch. When these trade-offs are possible, however, shunt MEMS switches can achieve series resistances as low as 0.07 Ω. (See, e.g., G. M. Rebeiz, RF MEMS, Theory, Design, and Technology, Wiley Interscience, 2002, incorporated herein in its entirety by reference.) FIG. 7 shows the simulated transmission response of the SBC for switch=0 and 0.15 Ω, respectively, representing the maximum and typical improvements attainable by using low-resistance MEMS switches. It is evident that reducing the series resistance to 0.15 Ω alone is nearly sufficient to bring the mid-band insertion loss of the filter within the 2.5 dB range required for the SDR system.

The total insertion loss can also be improved by reducing the attenuation of the coupled t-lines, through modifications of their cross-sectional geometry. However, it is often difficult to achieve $Q_{t\text{-}line}$ values of greater than 100 using a planar geometry, which can result in a maximum of 0.5 dB improvement in the insertion loss. Increasing the length of the coupling section and using lower impedance (wider) t-line sections provides some levels of improvement. However, these levels may be limited due to the longer coupled-line section requiring a stronger coupling often resulting in smaller inter-resonator gaps, higher edge current densities, and higher attenuation.

The insertion loss can also be reduced by using a lower order filter topology. (See, e.g., G. L. Matthaei, L. Young, and E. M. T. Jones, Microwave Filters, Impedance-matching networks, and Coupling Structures, New York, McGraw-Hill, 1964, incorporated herein in its entirety by reference.) FIG. 7 shows the simulated response of a 3-pole Chebyshev SBC. Using a lower order filter often requires stronger inter-resonator couplings and increases the t-line attenuation to the average value of α=5.5 dB at 1 GHz, which by itself has an adverse effect on the insertion loss. However, the effect of the reduced number of the MEMS switches is so significant that even with Rswitch=0.3 Ω the filter is capable of maintaining an insertion loss of less than 1.7 dB in all bands. The price of this improvement is the slower roll-off and lower out-of-band rejection as can be seen in FIG. 7.

B. Power Handling

The power handling capability of the SBC is dominated by the self-actuation of the MEMS switches, and the amount of current that can be safely handled by the membranes. To quantify these effects the currents and voltages across all MEMS switches may be calculated in different modes of operation. However, since the filter is expected to behave consistently in the different bands, the calculations are provided for the representative case of a filter tuned at 1 GHz under 12 W input RF. FIGS. 8-11 respectively present the transmission, capacitor voltages, and switch currents in the both the variable shorts and switchable capacitors vs. frequency. It should be noted that the capacitor voltages are equal to the voltages established across the open switches in the switchable capacitor bank. Also they represent an upper limit to the values of the voltage across the variable short switches which are in the up-state (open). As the peaking of the voltages and currents are more severe in low-loss filters, to obtain a worst case scenario, one can assume $Q_{t\text{-}line}$=100 and $R_{switch}$=0.15 Ω in these calculations. For simplicity, the rms values of voltages and currents are given. Simulations show that the values of the currents and voltages peak near the edges of the passband. From FIG. 9, to avoid self actuation under 12 watts of input power with a 50% margin, the MEMS switches should typically have a self actuation voltage of ≧50 V. Assuming a moderately high effective spring constant of $k_{eff}$=60 N/m and a bridge height of h=1.2 μm, this requires an up-state bridge capacitance of $C_{up}$=10 fF. While this value is not particularly hard to achieve, may require a small contact area and can compromise the contact resistance. An up-state capacitance of 60 fF is permissible with a h=2 μm and $k_{eff}$=120 N/m.

Figure 10:
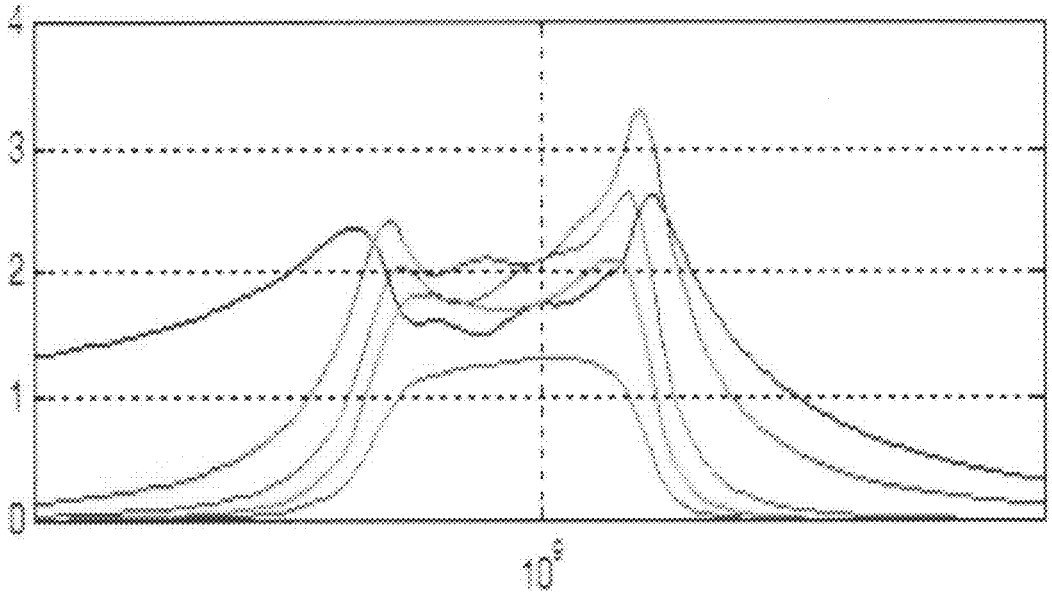
FIG. 10 depicts currents through the short circuited end of the resonators of a 5-pole SBC for a pass-band centered at 1 GHz with a reduced switch resistance of 0.15 and reduced t-line attenuation of $\alpha$=2 dB/m.
Figure 11:
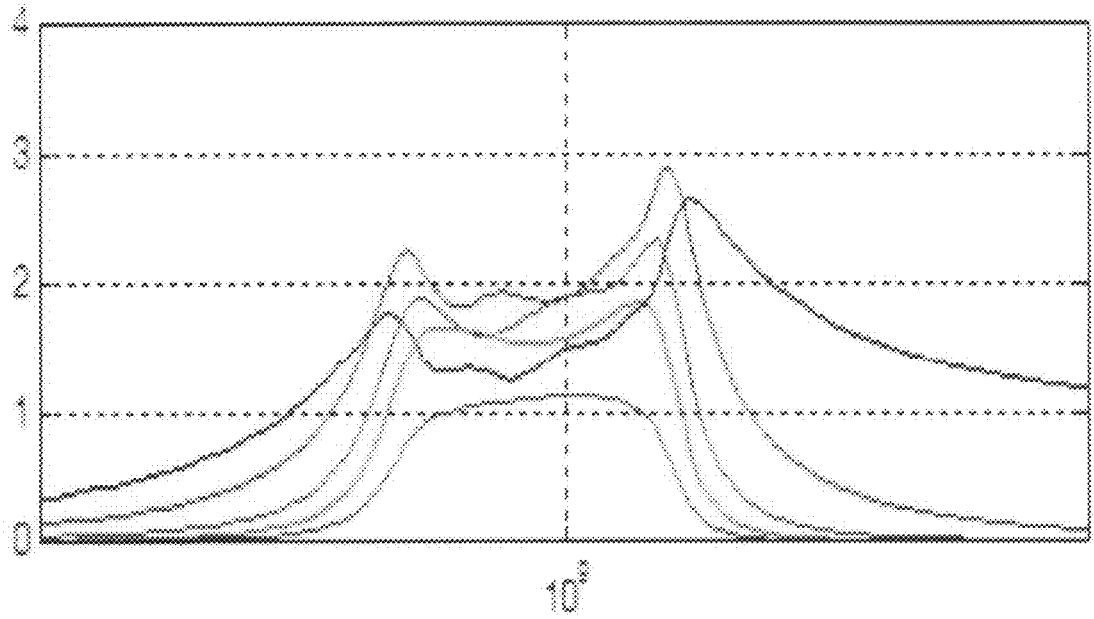
FIG. 11 depicts capacitor currents of a 5-pole SBC for a pass-band centered at 1 GHz with a reduced switch series resistance of 0.15 and reduced t-line attenuation of $\alpha$=2 dB/m.

The current handling of a MEMS switch is generally limited by the allowable temperature of the MEMS membrane. The dissipated power can be calculated from the rms current and switch resistance. FIGS. 10 and II show that a 12 W input RF can generate more than 3.3 A of rms current in the MEMS switches, which is equivalent to 3.27 W of dissipation (Rswitch=0.3 Ω). With a typical thermal resistance of 1000 K/W, this can result in temperatures as high as 3300° C. However, it should be noticed that these high temperatures are not reached immediately and the heating can be tolerably low if duration of the current peak is a small fraction of the thermal time constant of the bridge. For example, for a typical MEMS bridge with thermal time constant of 80 μs, a 1 μs pulse of 12 W power can raise the bridge temperature to only 65° C., which is manageable in almost any design. When the longer high-power pulses are expected, the system can be modified by adding a cooling unit, or electronic current protection circuitry. With the same notion and assuming a maximum allowable steady state temperature of 80° C., the CW power handling of the unprotected SBC is estimated to be 200 mW (−7 dBm).

Another issue associated with high power operation is the nonlinearity of the MEMS device, which is mainly due to the variations of the bridge height in the up-state as a result of high-power RF. The effect of this nonlinear phenomenon is expected to be minimal for a 30% SBC, as long as the up-state capacitors are kept within 10-20 fF.

V. Detailed Description of Several Additional Implementations

Figure 12:
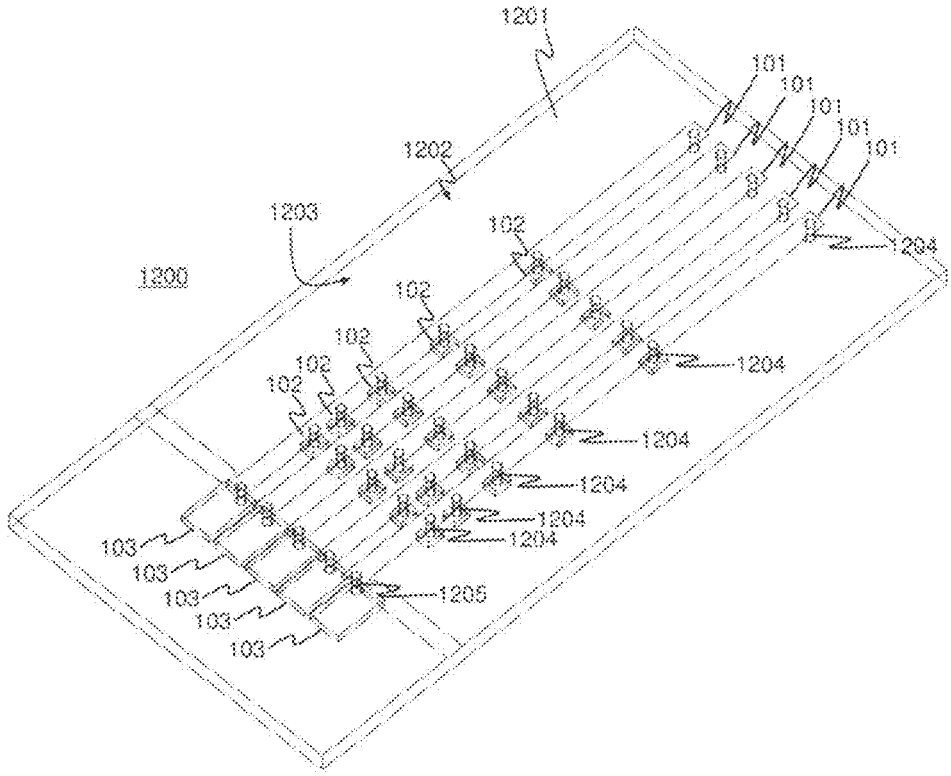
FIG. 12 is a wire perspective view of a 5-pole, 6-band SBC filter according to an embodiment of the invention using MEMS switches with transmission lines shown in outline to reveal underling via holes.
Figure 13:
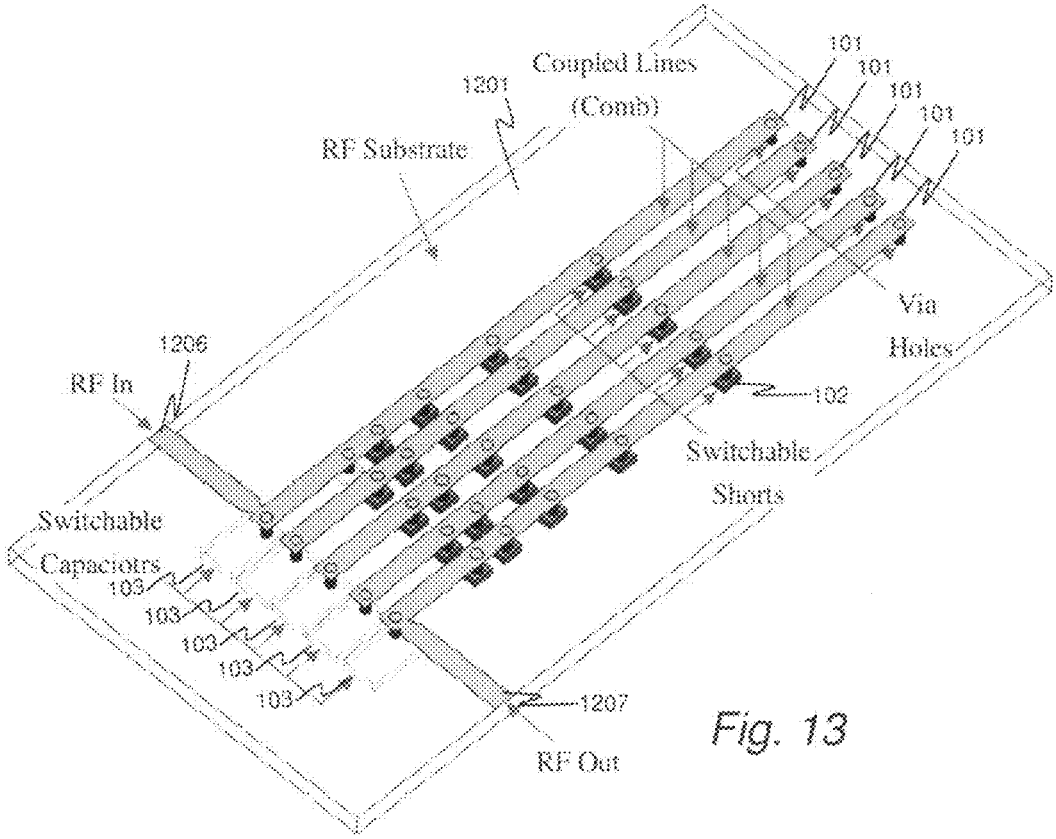
FIG. 13 is a top perspective view of the embodiment of FIG. 12.

One first embodiment of the invention includes an RF substrate with coupled transmission lines formed on or mounted on one (e.g., "top") side and switching and capacitor components and an RF ground plane or conductor formed on or attached to an opposite (e.g., "bottom") side. Via holes are used to provide electrical access to the transmission lines by components on the bottom side of the RF substrate. Thus, with reference to FIGS. 12 and 13, switchable bandpass filter 1200 includes RF substrate 1201 having an upper surface or top side 1202 and opposite lower surface or bottom side 1203. Coupled transmission lines 101 are formed on, mounted to, or otherwise attached to top side 1202. In the present example, five coupled transmission lines 101 are shown to provide a 5-pole SBC although any suitable number of transmission lines 101 can be implemented corresponding to the number of poles desired.

A number of via holes 1204 are provided at various positions along the length of and beneath each transmission line 101. MEMS switches 102 mounted on bottom side 1203 access locations along transmission lines 101 by way of the corresponding via holes 1204 formed in and through RF substrate 1201. The present example shows MEMS switches 102 located at six positions along the length of each transmission line 101 to provide a 7-mode SBC filter although any other number and positioning of MEMS switches may be used as required to satisfy filter design criteria and specifications.

MEMS switches 102 receive switching control signals (not shown) to selectively operate the switches to open and close and thereby electrically short circuit the corresponding location of the transmission line to ground by coupling that location of the transmission line to RF ground conductor 1204.

Switchable capacitors 103 are located at and are coupled to one end of respective transmission lines 101 by way of corresponding via holes 1205. Switchable capacitors 103 may be implemented as an array or tree of MEMS switched fixed capacitors, by a varactors, or any other suitable device for providing a variable capacitance loading for each transmission line in response to a control signal or voltage (not shown) provided by, for example, a controller circuit or microprocessor device, etc.

An input signal applied to RF input terminal 1206 is transmitted to a first one of transmission lines 101. Conversely, an output signal from the filter present at a final or last one of the transmission lines is transmitted to a subsequent device by RF output terminal 1207 that is coupled to the last transmission line.

Figure 14:
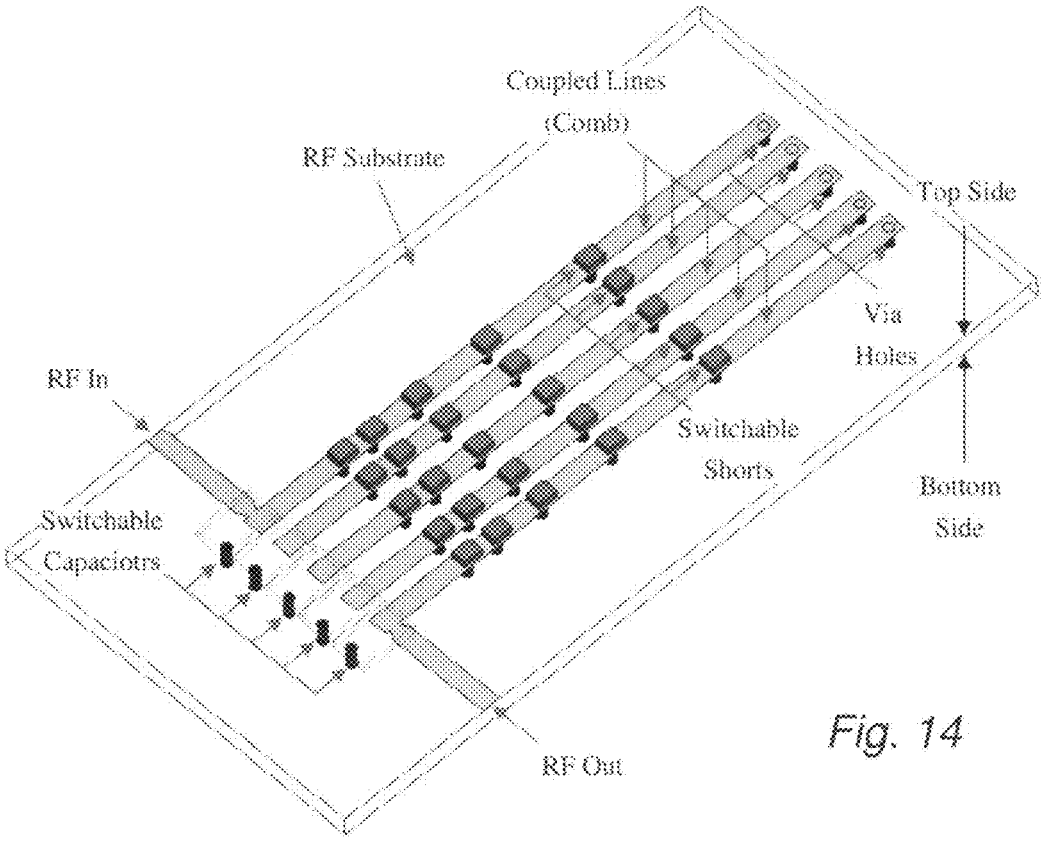
FIG. 14 is a top perspective view of an alternate embodiment of an 5-pole, 7-mode SBC filter with shunt switches mounted atop the transmission lines.

Another embodiment of the invention depicted in FIG. 14 provides for an alternate placement of the MEMS switches atop each of the transmission lines 101 instead of on an opposite side of RF substrate 1201. Thus, a plurality of MEMS switches 102 (in this example, five) are spaced along and atop each transmission line 101. In response to respective control signals, MEMS switches 102 selectively couple the transmission line at the location of the switch to RF ground conductor 1204 by way of via holes 1202 formed through the transmission lines and RF substrate 1201. As in the prior embodiment, switchable capacitors 103 may be mounted on the bottom side of RF substrate 1201 located at and are coupled to one end of respective transmission lines 101 by way of corresponding via holes 1205.

Another embodiment may provide for an alternate arrangement and mounting of various filter components. For example, a coplanar embodiment may provide for mounting of all components on one side of a substrate. In such a case, the transmission lines may be implemented as parallel coplanar waveguides with an underlying RF ground conductor. Surface mounted shunt switches or shorts (e.g., MEMS switches, PIN diodes, FET switches, etc.) may be used to electrically vary an effective length of each of the waveguides. Similarly, surface mounted switchable capacitors may be used to provide a selected capacitive loading for each waveguide.

Figure 15:
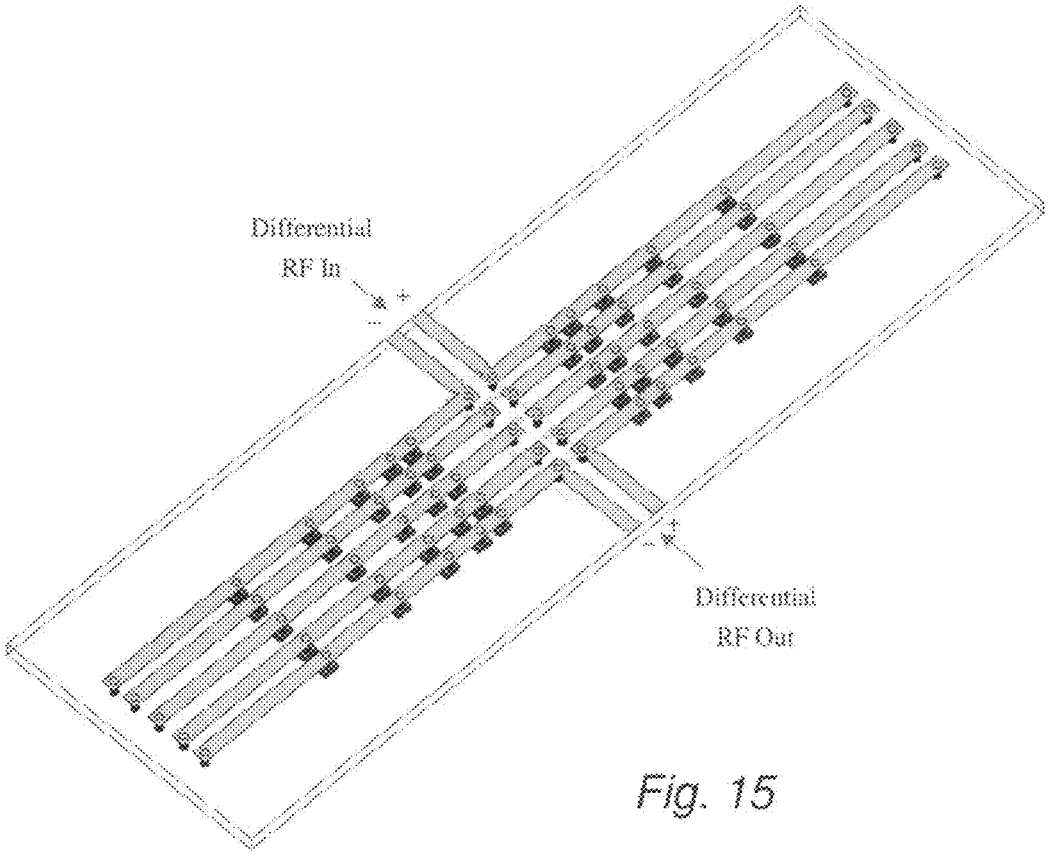
FIG. 15 is a top perspective view of a differential switchable filter utilizing a symmetric repetition of the switchable filter modules of FIGS. 12-13.
Figure 16:
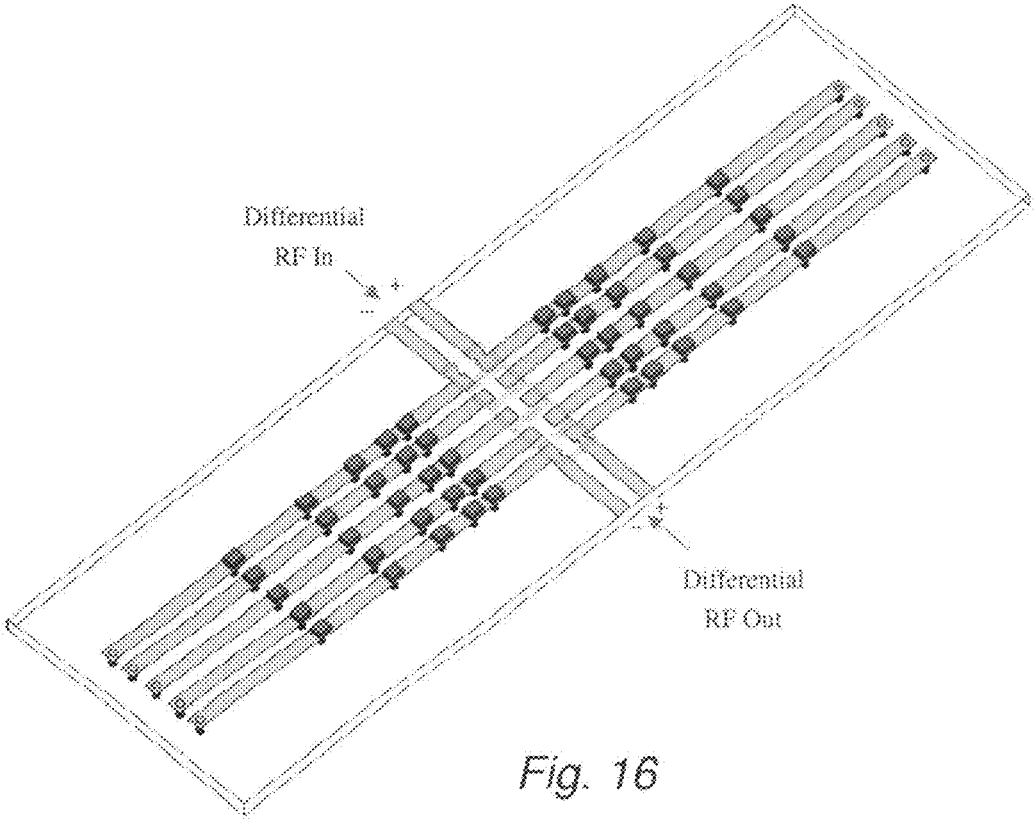
FIG. 16 is a top perspective view of a differential switchable filter utilizing a symmetric repetition of the switching modules of FIG. 14.

Other embodiments may include differential switchable filters using a plurality (e.g., two) symmetric repetitions of the previously described switchable filter arrangements, i.e., pairs of switchable filter modules. For example, FIG. 15 depicts such a differential switchable filter using a pair of switchable filter modules as previously depicted in and described with reference to FIGS. 12 and 13. Likewise, the differential switchable filter of FIG. 16 uses a pair of switchable filter modules corresponding to that depicted in FIG. 14 and described above. In these embodiments, the differential switchable filters comprise a symmetric repetition of a switchable filter modules, the differential switchable filter including a plurality of parallel coupled transmission lines each divided to two separated halves at their respective approximate midpoints, a pair of differential RF input terminals coupled to the two halves of a first one of the transmission lines, a pair of differential RF output terminals coupled to the two halves of a last one of the transmission lines, a first plurality of conductors coupling the two ends of each of the coupled transmission lines to the RF ground conductor, a second plurality of shunt switches at positions along a length of each of the transmission lines coupling respective ones of the transmission lines to the RF ground conductor, and a plurality of adjustable capacitors coupled in series between the two halves of each one of the coupled transmission lines.

Figure 17:
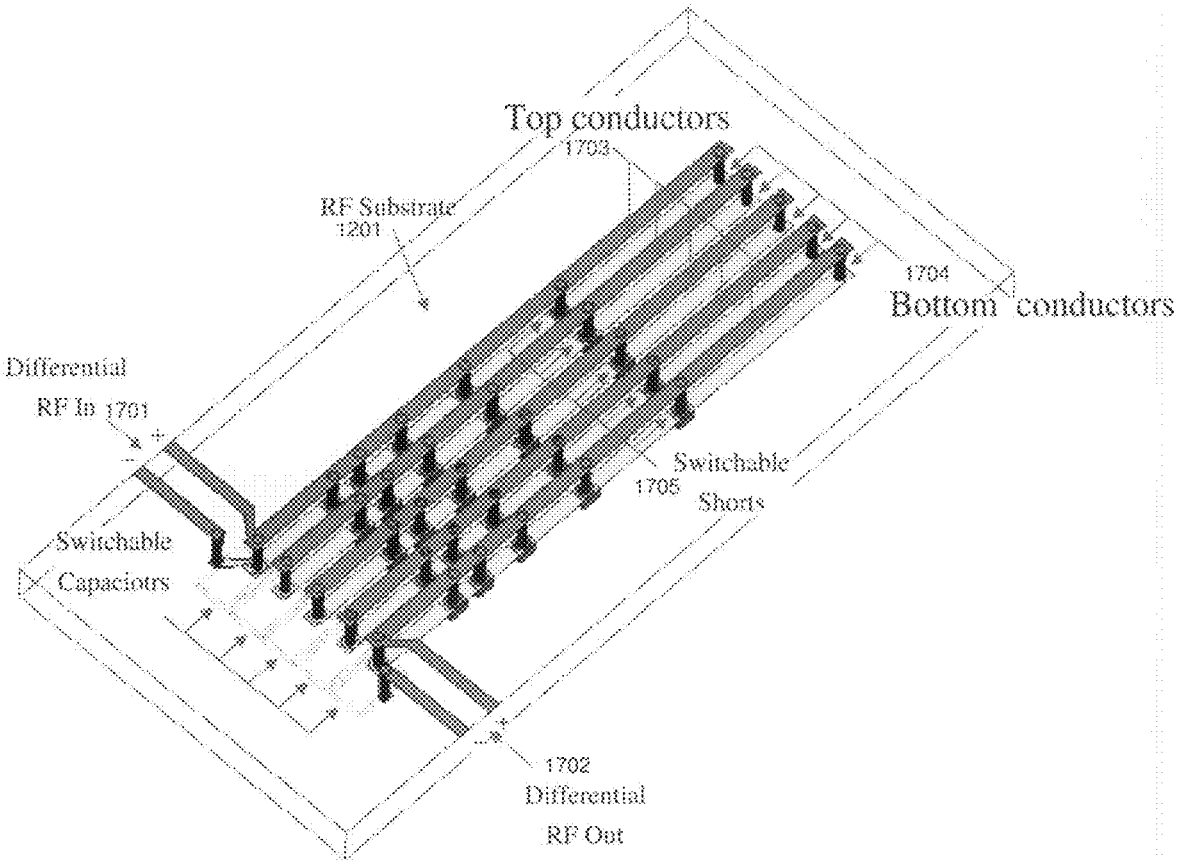
FIG. 17. is a top perspective view of a 5-pole 6-band differential switchable filter utilizing coupled transmission liens located on top and bottom sides of the substrate wherein the top portion substantially mirrors the bottom portion.

FIG. 17. shows yet another embodiment illustrated as a 5-pole 6-band differential switchable filter utilizing coupled transmission lines located on top and bottom sides of an RF substrate. As shown, each transmission line includes a pair of substantially opposing elongate conductors formed on respective opposing surfaces of sides of an RF substrate. The conductors of each pair substantially mirror each other, e.g., the top or upper conductor of each pair substantially mirrors the corresponding lower or bottom conductor.

It should again be noted and emphasized that, although the embodiments described herein are illustrative of various and specific implementations, embodiments of the invention may utilize alternative devices and methods for concurrently providing for electrical length adjust and capacitive loading of coupled transmission lines. Thus, while the various figures depict MEMS switches, other types and switching devices and equivalents may be used including but not limited to PIN diodes and FET switches. Likewise, various means and techniques may be used for adjusting capacitive loading of the transmission lines including switched arrays of capacitors, voltage variable capacitors (e.g., varactors), etc. Still further embodiments may use different numbers and configurations of transmission lines, numbers and positioning of shunt switches, etc.

Embodiments of the invention implement a compact filter solution usable in a variety of applications including, by way of example, the RF front-end the SDR system. The filter, which may be referred to as switched-band combline filter, may be fabricated using a wide range of devices for adjusting the electrical length of constituent coupled transmission lines such as by the integration of electrostatically actuated MEMS bridges in the structure of a pseudo-combline filter. Such a structure is adaptable to readily cover the upper 8 bands of SDR operation. The total size of a typical 5-pole SBC filter is less than 2×1 cm on a GaAs substrate, which is many times smaller than all other available alternatives. With low-resistance MEMS switches, the 5-pole SBC can achieve an in-band insertion loss of <2.5 dB in all modes of operation. For a 3-pole SBC, this value reduces to 1.7 dB with a typical RF MEMS switch. By a proper design of the MEMS switches, the SBC filter is capable of handling 200 mW in the CW mode, or 12 W of pulse RF with a duration of <1 μs. The MEMS SBC concept can be extended to design compact filters for the lower portion of SDR frequency range, based on the use of magneto-dielectric materials. Using a monolithic fabrication approach, the SBC filter design offers similar performance and size and cost benefits as compared to any solution based on the filter banks.

All of the methods disclosed and claimed herein can be executed without undue experimentation in light of the present disclosure. While the methods of this disclosure may have been described in terms of preferred embodiments, it will be apparent to those of ordinary skill in the art that variations may be applied to the methods and in the steps or in the sequence of steps of the method described herein without departing from the concept, spirit and scope of the disclosure. All such similar substitutes and modifications apparent to those skilled in the art are deemed to be within the spirit, scope, and concept of the disclosure as defined by the appended claims.

All publications, patents and patent applications mentioned in this specification and/or cited below are herein incorporated by reference to the same extent as if each individual publication, patent or patent application was specifically and individually indicated to be incorporated by reference in its entirety.

REFERENCES

Incorporated by Reference

[1]. G. L. Matthaei, L. Young, and E. M. T. Jones, *Microwave Filters, Impedance-matching networks, and Coupling Structures*, New York, McGraw-Hill, 1964.

[2]. J. S. Hong and M. J. Lancaster, *Microstrip Filters For RF/Microwave Application*, John Wiley and Sons, Hoboken, N.J., 2001.

[3]. G. M. Rebeiz, *RF MEMS, Theory, Design, and Technology*, Wiley Interscience, 2002.

[4]. L. Dusspot, and G. M. Rebeiz, "Intermodulation distortion and power handling in RF MEMS switches, varactors and tunable filters," *IEEE Trans. Microwave Theory and techniques*, vol. 51, 1247-1256, April 2003.

[5]. A. Abbaspour-Tamijani, L. Dussopt, and Gabriel M. Rebeiz, "Miniature and tunable filters using MEMS capacitors," *IEEE Trans. Microwave Theory and Techniques*, vol. 51, pp. 1878-1885, July 2003.

[6]. K. Entesari, and Gabriel M. Rebeiz, "A differential 4-bit 6.5-10 GHz RF MEMS tunable filter," *IEEE Trans. Microwave Theory and Techniques*, vol. 53, pp. 1103-1110, March 2005.

The invention claimed is:

1. A differential switchable filter comprising a symmetric repetition of switchable filter modules, said differential switchable filter including:

a plurality of parallel coupled transmission lines each divided to two separated halves at their respective approximate midpoints;

a pair of differential RF input terminals coupled to the two halves of a first one of the transmission lines;

a pair of differential RF output terminals coupled to the two halves of a last one of the transmission lines;

a first plurality of conductors coupling the two ends of each of the coupled transmission lines to the RF ground conductor;

a second plurality of shunt switches at positions along a length of each of the transmission lines coupling respective ones of the transmission lines to the RF ground conductor; and a plurality of adjustable capacitors coupled in series between the two halves of each one of the coupled transmission lines.

2. The switchable bandpass filter according to claim 1 wherein said first plurality of conductors are selected from the group consisting of (i) via holes and (ii) coplanar shorts.

3. A differential switchable filter comprising:

a plurality of parallel coupled transmission lines, each transmission line having two conductors located on respective top and bottom sides of a substrate and substantially mirroring each other;

a pair of differential RF input terminals coupled to respective top and bottom conductors of a first one of the transmission lines;

a pair of differential RF output terminals coupled to respective top and bottom conductors of a last one of the transmission lines;

a first plurality of via holes connecting a first end of each pair of the top and bottom conductors of the coupled transmission lines;

a second plurality of via holes at positions along the length of each of the transmission lines and coupling to the top conductors of the respective transmission line;

a plurality of shunt switches placed at positions along the bottom conductor of each of the transmission lines and coupling said second plurality of via holes with the top conductor of the respective transmission line; and a plurality of adjustable capacitors connected between a second end of each pair the top and bottom conductors of the coupled transmission lines.

* * * * *